US007728223B2

(12) United States Patent
Shintani

(10) Patent No.: US 7,728,223 B2
(45) Date of Patent: Jun. 1, 2010

(54) FLAT CABLE FOR MOUNTED DISPLAY DEVICES

(75) Inventor: Peter Shintani, San Diego, CA (US)

(73) Assignees: Sony Corporation, Tokyo (JP); Sony Electronics, Inc., Parkridge, NJ (US)

( * ) Notice: Subject to any disclaimer, the term of this patent is extended or adjusted under 35 U.S.C. 154(b) by 1 day.

(21) Appl. No.: 12/134,118

(22) Filed: Jun. 5, 2008

(65) Prior Publication Data

US 2009/0301755 A1 Dec. 10, 2009

(51) Int. Cl.
*H01B 11/06* (2006.01)

(52) U.S. Cl. ..... 174/33

(58) Field of Classification Search ..... 174/32, 174/33, 34, 117 FF

See application file for complete search history.

(56) References Cited

U.S. PATENT DOCUMENTS

2004/0127091 A1 7/2004 Naito et al.
2006/0239310 A1 10/2006 Salz
2008/0106306 A1* 5/2008 Keady et al. ..... 327/100
2009/0102974 A1* 4/2009 Ishimura ..... 348/572
2009/0147864 A1* 6/2009 Lida et al. ..... 375/257

FOREIGN PATENT DOCUMENTS

WO 2006044770 A1 4/2006

OTHER PUBLICATIONS

AVTOAD; Wireworld Silver Starlight 5 HDM/DVI; http://www.avtoad.co.uk/catalog/product_info.php?products_id=255; 2007.

* cited by examiner

*Primary Examiner*—Chau N Nguyen

(57) ABSTRACT

A flat high definition multimedia interface (HDMI) cable. The flat cable that is less visible in comparison to a round HDMI cable for wall mounted television setup. An HDMI connector is coupled to the flat cable. An active circuit isolates physical characteristics of the HDMI connector. The active circuit causes the flat cable to appear shorter than its actual length during HDMI compliance testing using impedance testing. Moreover, the active circuit causes a consumer electronic control (CEC) line, a display data channel (DDC) line and transition minimized differential signal (TMDS) line to actively terminate for reducing parasitic capacitance from the length of the flat cable during HDMI compliance testing. Thus, the isolation allows the flat cable to satisfy HDMI compliant testing. The flat cable may be selected from a group consisting of ribbon cable, twisted pair cable, flexible printed circuit board, micro coax cable, optical cable and glass fiber cable.

18 Claims, 3 Drawing Sheets

100

300

FLAT CABLE FOR MOUNTED DISPLAY DEVICES

TECHNICAL FIELD

Embodiments of the present invention relate to the field of electronics. More particularly, embodiments of the present invention relate to a cable for supplying signals to a mounted display device.

BACKGROUND ART

With advent of flat screen televisions, more and more consumers are utilizing flat screen televisions not only for their excellent picture quality but also because they are less bulky and more decorative. As a result, many consumers mount their television sets on a wall, for example above a fireplace, etc.

In general, flat screen televisions have high definition multimedia interface (HDMI) capability. HDMI facilitates uncompressed digital signals for the highest picture and sound quality. Moreover, the HDMI cable provides one common cable for video, audio and control signals and enables communication and control between electronic devices instead of having individual and separate cables for video, audio and control signals, etc. Additionally, HDMI cables are compatible with personal computers (PC). Furthermore, the HDMI signal automatically displays and matches for resolution, format and aspect ratio.

Even though a wall mounted television is visually pleasing, it nevertheless requires a signal and a power cable to transfer content and control signals. While some users may be able to route AC power or pay technicians to route AC power near to the set, most flat screen television sets that are HDMI capable still have the visible HDMI cable hanging from the wall. Moreover, passing through an HDMI cable, like routing AC power, is difficult and relatively technical and expensive.

Unfortunately, HDMI cables are large and visible, e.g., some cables are 5-6 mm in diameter. Thus, when an HDMI cable is connected to a television set mounted on a wall, the HDMI cable is visible, hard to conceal and hangs down from the side of the wall as it connects to another electronic device, e.g., receiver, DVD player, etc. An HDMI cable hanging from a mounted television set is neither decorative nor practical.

HDMI cables that are flatter than the conventional round HDMI cable have been developed. However, even the flatter version is still visible. For example, the flatter version is in general about 4 mm thick.

Fattening an HDMI cable may be possible, but physical characteristics of the HDMI cable change in the process. For example, controlling the attenuation and impedance become very difficult in a flattened cable. Thus, flattening an HDMI cable, while possible, makes it challenging for the HDMI cable to pass HDMI compliance tests.

HDMI compliance testing is generally subject to two separate tests. The first test may be referred to as an "eye pattern" test where an actual signal representing the worst case source device output is fed through the cable and the output at the other end of the cable is measured graphically on an oscilloscope. The eye pattern test shows the height of the "eye" representing the signal amplitude that should not fall into or become smaller than a given threshold. The eye pattern test may also show the rising and failing edges of digital bits that do not always occur at the same time, thereby leading to timing jitter. The internal width of the eye cannot fall into or become narrower than a given threshold. In other words, if the signal collapses in either the vertical direction or the horizontal direction, the signal is lost. The second test may be referred to as the "parametric test" where various attributes such as skew, crosstalk and attenuation are measured.

In another effort to eliminate the visual HDMI cables, a wireless HDMI technology, e.g., radio frequency (RF) technology, may be used. Wireless HDMI technology uses wireless communication while taking advantage of HDMI technology. Unfortunately, while wireless HDMI may provide communication wirelessly and eliminate the visible cable, it is expensive to implement. Thus, wireless HDMI is not readily used by a wide range of consumers.

SUMMARY

Accordingly, a need has arisen to develop a high definition multimedia interface (HDMI) cable that is less visible, e.g., low profile, and can facilitate use by a mounted television set. Moreover, a need has arisen to develop an HDMI cable that is cost effective to manufacture while satisfying HDMI cable compliance testing. It will become apparent to those skilled in the art in view of the detailed description below that the embodiments of the present invention satisfy the above mentioned needs.

In one embodiment of the present invention, an HDMI cable that complies with HDMI testing requirements is provided. The HDMI cable is a flat cable that is of low profile and therefore less visible relative to a conventional HDMI cable. For example, the flat cable may be less than or equal to 3 millimeter thick and comprise less than or equal to nineteen wires. Thus, a relatively inexpensive flat cable technology can be used such as, ribbon cable, twisted pair cable, flexible printed circuit board cable, micro coax cable, optical cable and/or glass fiber cable, etc. The flat cable may have an HDMI connector coupled to one end. The HDMI connector may be an external connector, e.g., of type A, B and/or C, etc.

Moreover, an active circuit may be coupled to the HDMI connector and thereby further coupled to the flat cable. In accordance with embodiments of the present invention, the active circuit isolates the physical characteristics of the HDMI connector. For example, the active circuit may cause the flat cable to appear shorter than its actual length during HDMI compliance testing, e.g., impedance testing. Similarly, the active circuit may cause a consumer electronic control (CEC) line and/or a display data channel (DDC) line and/or transition minimized differential signal (TMDS) line to actively terminate. Thus, parasitic capacitance from the length of the flat cable is reduced during HDMI compliance testing. In one embodiment, the active circuit may be integrated within the flat cable. Moreover, in another embodiment, additional active circuits may be used. For example, one active circuit may be used to couple the flat cable to a television set and another active circuit may be used to couple the flat cable to the HDMI connector that connects to another electronic device.

One embodiment of the present invention pertains to a method of providing an HDMI compliant cable that includes providing a communication channel between a first and a second electronic device via a flat cable, wherein the flat cable is of low profile and therefore less visible in comparison to a round HDMI cable; isolating physical characteristics of a connector of the HDMI cable, wherein the isolation is operable to facilitate HDMI compliance testing of the flat cable; and providing a connection for coupling said HDMI cable to the first electronic device, wherein the connection is established via the connector of the HDMI cable.

In one embodiment, the flat cable may be selected from a group consisting of ribbon cable, twisted pair cable, flexible printed circuit board, micro coax cable, optical cable and glass fiber cable and the like. According to one embodiment, the HDMI connector may be selected from a group consisting of type A, type B and type C external connectors.

In one embodiment, isolation is performed via an active circuit. In one exemplary embodiment, isolation may cause the flat cable to appear shorter than its actual length during HDMI compliance testing, e.g., impedance testing. In one embodiment, isolation may cause CEC, DDC and TMDS lines to actively terminate for reducing parasitic capacitance from the length of the flat cable during HDMI compliance testing.

Accordingly, physical characteristics of the HDMI connector are isolated. Thus, a less visible and relatively inexpensive flat cable can be provided that also complies with HDMI compliance testing. The low profile cable can be particularly well suited for wall mounted applications of flat panel televisions.

BRIEF DESCRIPTION OF THE DRAWINGS

Embodiments of the present invention are illustrated by way of example, and not by way of limitation, in the figures of the accompanying drawings and in which like reference numerals refer to similar elements and in which.

DETAILED DESCRIPTION

Reference will now be made in detail to embodiments of the present invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be evident to one of ordinary skill in the art that the present invention may be practiced without these specific details. In other instances, well known methods, procedures, components, and circuits have not been described in detail as not to unnecessarily obscure aspects of the invention.

Flat Cable for Mounted Display Devices

Figure 1:
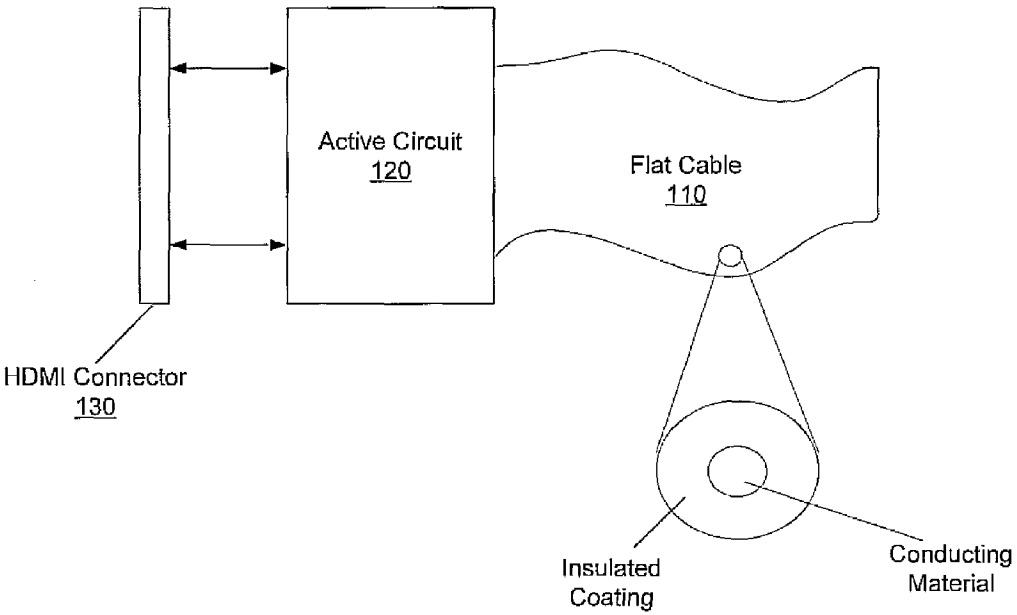
FIG. 1 shows an exemplary high definition multimedia interface (HDMI) cable device in accordance with one embodiment of the present invention.

Referring now to FIG. 1, an exemplary high definition multimedia interface (HDMI) cable device 100 in accordance with one embodiment of the present invention is shown. In one embodiment, the HDMI cable 100 comprises a flat or low profile cable section 110 coupled to an active circuit 120 which may be coupled to an HDMI connector 130.

In one embodiment, the flat cable portion 110 may be fabricated using a relatively inexpensive flat cable technology, e.g., ribbon cable, twisted pair ribbon, flexible printed circuit board, micro coax, optical cable, glass fiber, etc. The flat cable portion 110 is of lower profile and therefore less visible in comparison to conventional HDMI cables especially for wall mounted television applications. For example, the flat cable portion 110 may be 2 mm thick in comparison to a conventional HDMI cable of approximately 5.5 mm diameter. In one exemplary embodiment, the flat cable portion 110 may comprise a plurality of conductors and shields, e.g., less than or equal to nineteen conductors. A cut out cross section of the flat cable portion 110 is shown that includes a conductive material surrounded by an insulating coating material. e.g., shields.

In one embodiment, the surface of the flat cable portion 110 may be such that it is readily paintable. Thus, the flat cable portion 110 may be laid flat on a mounting wall and painted, thereby making the HDMI cable 100 substantially invisible. In one embodiment, the flat cable portion 110 may also be placed inside a wall without substantial damage since the flat cable portion 110 is relatively smaller and flatter in comparison to the conventional HDMI cable.

As discussed above, flattening an HDMI cable may alter its physical characteristics, e.g., attenuation and impedance. Accordingly, for HDMI cable compliance testing it is important to isolate certain physical characteristics of the HDMI cable connector in order for the HDMI cable to remain in compliance with HDMI testing requirements. Thus, isolating physical characteristics of the HDMI cable connector, e.g., HDMI connector 130, enables the flattened HDMI cable 100 to satisfy HDMI compliance testing, e.g., HDMI specifications 1.1-1.3a and/or compliance test specifications 1.1-1.3b1. It is appreciated that the HDMI connector 130 may be an external connector. Moreover, it is appreciated that the HDMI connector 130 may be of type A, type B, type C, etc.

In order to isolate physical characteristics of the HDMI connector 130, the active circuit 120 is used in accordance with embodiments of the present invention. In one exemplary embodiment, the active circuit 120 may be a one input one output circuit such as the sii9181 component circuit for instance. Similarly, the active circuit 120 may be a three to one circuit such as sil9185 for instance. The active circuit 120 isolates the physical characteristics of the HDMI connector 130 such that the detected impact of the flat cable portion 110 is reduced and preferably minimized. For example, the active circuit 120 may cause a consumer electronic control (CEC) line to actively terminate. As a result, the parasitic capacitance from the length of the flat cable portion 110 during HDMI compliance testing may be reduced. Similarly, the active circuit 120 may cause a display data channel (DDC) line and/or transition minimized differential signal (TMDS) line to actively terminate. Thus, the parasitic capacitance from the length of the flat cable portion 110 during HDMI compliance testing may similarly be reduced.

As the length of the HDMI cable increases, the signal quality of the HDMI cable decreases. Thus, it becomes more challenging to satisfy HDMI testing compliance requirements. However, as presented and discussed above, using the active circuit 120 isolates physical characteristics of the HDMI connector 130. Thus, the impact of the flat cable's length on compliance testing is reduced and/or ideally minimized. As a result, longer flat cables may be used without impacting the result of HDMI compliance testing. In other words, the active circuit 120 advantageously causes the flat cable portion 110 to appear shorter than its actual length during HDMI compliance testing, e.g., impedance testing.

It is appreciated that even though the active circuit 120 is shown separate from the flat cable portion 110 and the HDMI connector 130, it may be integrated within either and/or both components. For example, the active circuit 120 may be integrated within the flat cable portion 110. It is further appreciated that the HDMI connector 130 may be coupled to one electronic device, e.g., tuner, receiver, DVD player, etc. Moreover, it is appreciated that the flat cable portion 110 may also be coupled to a television set (not shown) from the opposite end. It is also appreciated that the HDMI cable 100 may further comprise an additional active circuit (not shown) at the opposite end of the HDMI connector 130.

Figure 2:
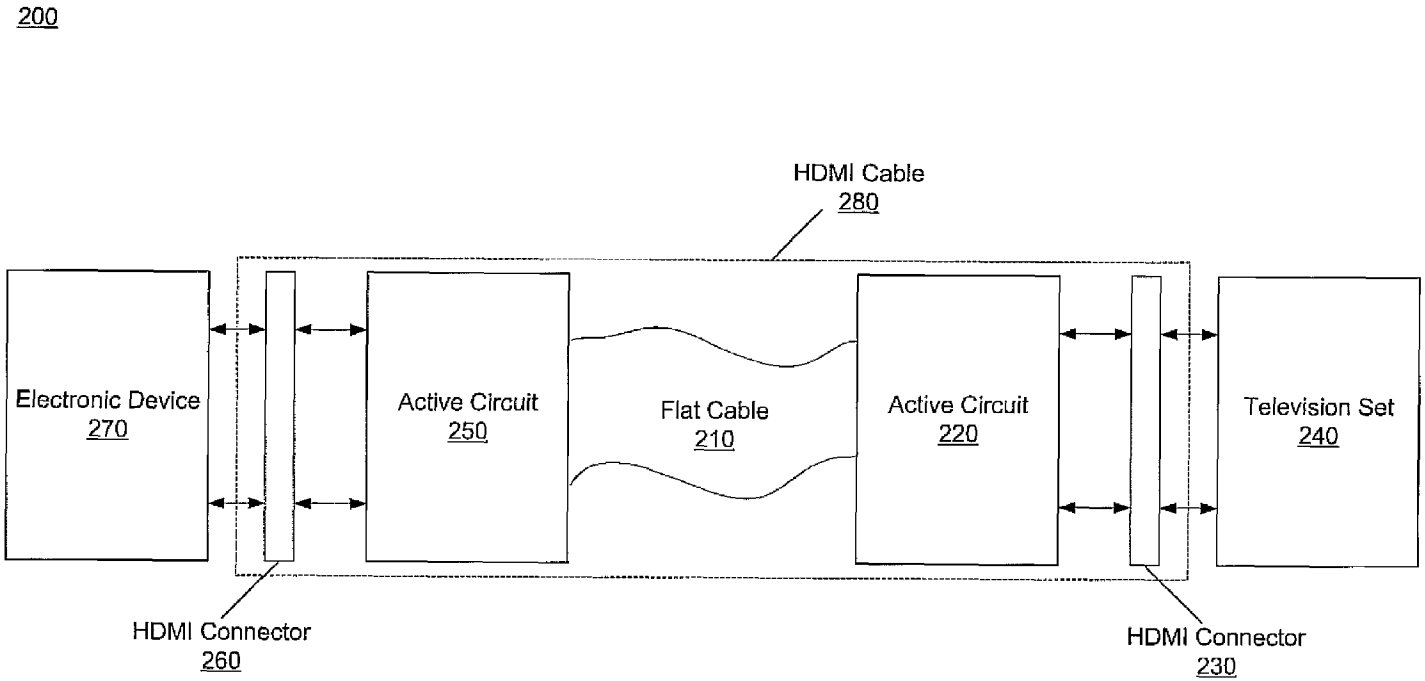
FIG. 2 shows an exemplary HDMI enabled electronic system in accordance with one embodiment of the present invention.

Referring now to FIG. 2, an exemplary HDMI enabled electronic system 200 in accordance with one embodiment of the present invention is shown. The system 200 comprises an HDMI cable device 280 in accordance with one embodiment of the present invention that is coupled from one end to an electronic device 270 and further connects to a television set 240 via the opposite end. It is appreciated that the HDMI cable device 280 may be a permanent affixed portion of the television set 240.

It is appreciated that the HDMI cable 280 is substantially similar to the HDMI cable 100 of FIG. 1. However, in this exemplary embodiment, the HDMI cable 280 comprises two active circuits and two HDMI connectors. For example, the HDMI cable 280 comprises a flat cable portion 210 that is coupled to an active circuit 250 from one end and further coupled to an active circuit 220 from the other end. Moreover, the active circuit 220 may be coupled to an HDMI connector 230 while the active circuit 250 may be coupled to an HDMI connector 260.

It is appreciated that the active circuits 220 and 250 function substantially similar to the active circuit 120 described above. Moreover, it is appreciated that the flat cable portion 210 functions substantially similar to the flat cable portion 110 of FIG. 1. It is further appreciated that the HDMI connectors 230 and 260 function substantially similar to the HDMI connector 130 of FIG. 1.

In one embodiment, the active circuit 220 may be integrated within the flat cable portion 210. Similarly, the active circuit 250 may be integrated within the flat cable portion 210. The HDMI cable 280 in accordance with one embodiment of the present invention may be connected to a television set 240 and further coupled to the electronic device 270, e.g., tuner, receiver, DVD player, etc. The HDMI cable 280 may be connected to the television set 240 and be a permanent affixed portion of the television set 240.

It is appreciated that having an active circuit on each side of the flat cable portion 210 isolates physical characteristics of HDMI connectors 230 and 260. Thus, the flat cable portion 210 can be longer while allowing the HDMI cable 280 to comply with HDMI compliance requirements. In other words, active circuit 220 and/or 250 cause the flat cable portion 210 to appear shorter than its actual length during HDMI compliance testing, e.g., impedance testing. Similarly, having an active circuit on each side of the flat cable portion 210 may cause a CEC line and/or a DDC line and/or TMDS line to actively terminate, thereby reducing parasitic capacitance due to the length of the flat cable portion 210 during HDMI compliance testing.

Accordingly, a flat, less visible and relatively inexpensive pigtail can be used while enabling the HDMI cable to satisfy HDMI compliance testing. As a result, visibility of the HDMI cable is reduced for wall mounted applications. It is appreciated that the term pigtail in one embodiment may refer to a cable that is integrated within an electronic device.

Figure 3:
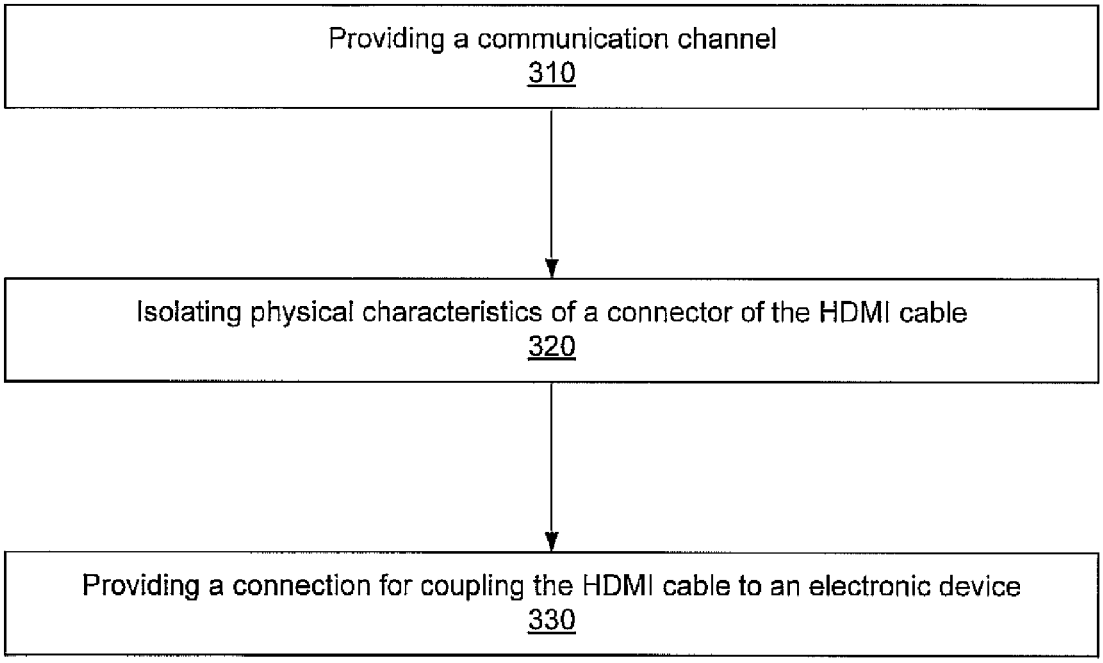
FIG. 3 shows an exemplary flow diagram for providing an HDMI compliance cable in accordance with one embodiment of the present invention.

Referring now to FIG. 3, an exemplary flow diagram 300 for providing a flat HDMI compliance cable in accordance with one embodiment of the present invention is shown. At step 310, a communication channel is provided. The communication channel may be provided between two electronic devices, e.g., a television set and a receiver, via a flat cable. According to one embodiment of the present invention, the flat cable is of a low profile and therefore less visible for that surface mounting applications in comparison to a round HDMI cable. The flat cable may be fabricated of a relatively inexpensive ribbon cable, twisted pair ribbon, flexible printed circuit board, micro coax, optical cable, glass fiber, etc. In one exemplary embodiment, the flat cable may be 2 mm thick in comparison to a conventional HDMI cable of approximately 5.5 mm diameter. Moreover, in one exemplary embodiment, the flat cable may comprise a plurality of conductors and shields, e.g., less than or equal to nineteen wires.

It is appreciated that in one embodiment, the surface of the flat cable may be paintable. Thus, the flat cable may be laid flat on a mounting wall and painted, thereby making the HDMI cable substantially invisible within a wall mounted system. In one embodiment, the flat cable may be placed inside the wall without substantial damage to the wall since the flat cable is relatively smaller and flatter in comparison to a conventional HDMI cable.

At step 320, physical characteristics of a connector of the HDMI cable are isolated using an active circuit. For example, isolation may cause the length of the flat cable may appear shorter during HDMI compliance testing, e.g., impedance testing. Similarly the isolation may cause a CEC line and/or a DDC line and/or TMDS line to actively terminate, thereby reducing parasitic capacitance from the length of the flat cable during HDMI compliance testing. It is appreciated that in one embodiment, an active circuit may be used to isolate the physical characteristics of the HDMI connector. For example, a one input one output circuit such as the sii9181 circuit component may be used as the active circuit. As a result, isolation enables the use of a relatively inexpensive, less visible and flat cable while still satisfying requirements of HDMI compliance testing.

It is appreciated that isolation via the active circuit may be provided on one side and/or both sides of the HDMI cable. At step 330, a connection for coupling the HDMI cable to an electronic device is provided. For example, an HDMI connector may be used and coupled to the flat cable in order to couple the HDMI cable to an electronic device, e.g., receiver, tuner, DVD player, etc. It is appreciated that additional HDMI connectors may be used to couple the HDMI cable to a television set at the opposite end. In one embodiment, the HDMI connectors may be external connectors such as of type A, type B, type C, etc.

In the foregoing specification, embodiments of the invention have been described with reference to numerous specific details that may vary from implementation to implementation. Thus, the sole and exclusive indicator of what is, and is intended by the applicants to be, the invention is the set of claims that issue from this application, in the specific form in which such claims issue, including any subsequent correction. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. An electronic device comprising:

a display device; and a high definition multimedia interface (HDMI) cable connected to said display device, and wherein said HDMI cable comprises:

a flat cable portion wherein said flat cable portion is of low profile and therefore less visible in comparison to a round cable in shape;

an HDMI connector coupled to said flat cable portion; and a first active circuit coupled to said flat cable portion and further coupled to said HDMI connector, wherein said first active circuit is operable to isolate physical characteristics of said HDMI connector for facilitating HDMI compliance testing of said HDMI cable device, wherein said first active circuit causes said flat cable portion to appear shorter than its actual length during an impedance test of the HDMI compliance testing.

2. The electronic device as described in claim 1, wherein said flat cable portion is selected from a group consisting of ribbon cable, twisted pair cable, flexible printed circuit board, micro coax cable, optical cable and glass fiber cable.

3. The electronic device as described in claim 1 wherein said HDMI connector is selected from a group consisting of a type A, type B and type C external connectors.

4. The electronic device as described in claim 1 wherein said flat cable portion is substantially less than or equal to 3 millimeter thick, and wherein said flat cable portion comprises a plurality of insulated conductors.

5. The electronic device as described in claim 1 further comprising:

a second active circuit coupled to said flat cable portion, wherein said second active circuit is coupled to the opposite end of said flat cable from said first active circuit.

6. The electronic device as described in claim 1, wherein said first active circuit is integrated within said flat cable portion.

7. The electronic device as described in claim 1, wherein said first active circuit causes consumer electronic control (CEC), display data channel (DDC) and transition minimized differential signal (TMDS) lines to actively terminate for reducing parasitic capacitance from a length of said flat cable portion during HDMI compliance testing.

8. A high definition multimedia interface (HDMI) enabled electronic system comprising:

a first electronic device comprising:

a display device; and a high definition multimedia interface (HDMI) cable connected to said display device, and wherein said HDMI cable comprises:

a flat cable portion that is low profile and therefore less visible in comparison to a round cable, and wherein said flat cable portion is coupled to said first electronic device;

an HDMI connector coupled to said flat cable portion; and a first active circuit coupled to said flat cable portion and further coupled to said HDMI connector, wherein said first active circuit is operable to isolate physical characteristics of said HDMI connector to facilitate HDMI compliant testing, wherein said first active circuit causes consumer electronic control (CEC), display data channel (DDC) and transition minimized differential signal (TMDS) lines to actively terminate for reducing parasitic capacitance from a length of said flat cable portion during HDMI compliance testing; and a second electronic device coupled to said HDMI cable, wherein said second electronic device is operable to communicate with said first electronic device via said HDMI cable.

9. The system as described in claim 8, wherein said flat cable portion is selected from a group consisting of ribbon cable, twisted pair cable, flexible printed circuit board, micro coax cable, optical cable and glass fiber cable.

10. The system as described in claim 8 wherein said HDMI connector is selected from a group consisting of a type A, type B and type C external connectors.

11. The system as described in claim 8 wherein said flat cable portion is less than or equal to 3 millimeter thick, and wherein said flat cable portion comprises a plurality of insulated conductors.

12. The system as described in claim 8 further comprising:

a second active circuit coupled to said flat cable portion, wherein said second active circuit is coupled to the opposite end of said flat cable portion from said first active circuit.

13. The system as described in claim 8, wherein said first active circuit is integrated within said flat cable portion.

14. The system as described in claim 8 wherein said first active circuit causes said flat cable portion to appear shorter than its actual length during an impedance test of the HDMI compliance testing.

15. A method of providing a high definition multimedia interface (HDMI) compliant cable, said method comprising:

providing a communication channel between a first and a second electronic device via an HDMI cable device comprising a flat cable, wherein said flat cable is low profile and therefore less visible in comparison to a round cable;

isolating physical characteristics of a connector of said HDMI cable device, wherein said isolation is operable to facilitate HDMI compliant testing of said HDMI cable device, wherein said isolating uses an active circuit coupled to said flat cable, and wherein said isolating causes consumer electronic control (CEC), display data channel (DDC) and transition minimized differential signal (TMDS) lines to actively terminate for reducing parasitic capacitance from a length of said flat cable during HDMI compliance testing; and providing a connection for coupling said HDMI cable device to said first electronic device, wherein said connection is via said connector of said HDMI cable device.

16. The method as described in claim 15 wherein said flat cable is selected from a group consisting of ribbon cable, twisted pair cable, flexible printed circuit board, micro coax cable, optical cable and glass fiber cable.

17. The method as described in claim 15 wherein said HDMI connector is selected from a group consisting of a type A, type B and type C external connectors.

18. The method as described in claim 15 wherein said isolating causes said flat cable to appear shorter than its actual length during impedance testing of said HDMI compliance testing.

* * * * *